US005356199A

United States Patent [19]

Elzenbeck et al.

[11] Patent Number: 5,356,199

[45] Date of Patent: Oct. 18, 1994

[54] MECHANISM FOR MOUNTING THE SEAT OF A SWIVEL CHAIR ON A CHAIR FRAME

[75] Inventors: Manfred Elzenbeck, Steinheim; Burkhard Vogtherr, Kandern, both of Fed. Rep. of Germany

[73] Assignee: Fritz Hansen A/S, Allerod, Denmark

[21] Appl. No.: 927,402

[22] Filed: Sep. 28, 1992

[30] Foreign Application Priority Data

Mar. 28, 1990 [DE] Fed. Rep. of Germany ... 9003589[U]

[51] Int. Cl.[5] ..... A47C 1/031

[52] U.S. Cl. ..... 297/313; 297/311

[58] Field of Search ..... 297/300–302, 297/304, 313, 326, 344, 344.1, 344.15, 311

[56] References Cited

U.S. PATENT DOCUMENTS 4,911,501 3/1990 Decker et al. ..... 297/302 X

FOREIGN PATENT DOCUMENTS 0179204 7/1954 Austria ..... 297/302
0284272 9/1988 European Pat. Off. .
3638273 4/1988 Fed. Rep. of Germany .
3800751 8/1988 Fed. Rep. of Germany .
2267068 7/1975 France .

*Primary Examiner*—Peter R. Brown
*Assistant Examiner*—Milton Nelson, Jr.
*Attorney, Agent, or Firm*—Fred Philpitt

[57] ABSTRACT

A mechanism for mounting the seat of a swivel chair to the chair frame, with a first mounting which can be connected to the frame, with a second mounting carried by the first mounting via a joint, which can be connected to the seat and with a spring arrangement for the initial tensioning of the second mounting in an upper position of rest, locking parts on said first and second mounting which are adapted to be engaged and disengaged by a locking slide.

6 Claims, 4 Drawing Sheets

MECHANISM FOR MOUNTING THE SEAT OF A SWIVEL CHAIR ON A CHAIR FRAME

FIELD OF THE INVENTION

The invention concerns a mechanism for mounting a seat of a swivel chair on a chair frame.

BACKGROUND

This type of mechanism is described in FR-A-2 267 068. In order to guarantee that the mobile mounting swivels freely, it has an angular pitched stop face which, together with a casing-fixed counter face forms a stop. In the normal position given by the leaf spring arrangement, the two stop faces form a wedge-shaped slot into which a correspondingly wedge-shaped locking slide can be inserted. This type of wedge locking is, however, non-interacting; particularly if the locking slide is not pushed tightly between the stop faces, it is possible for the latter to be pushed back into the release position when load is applied to the swivel mounting. The variable path of the locking slide between the release position and the fully inserted position between the stop faces giving a wedge-shaped slot is also large.

In DE-A-36 38 273, a stop adjustment for a tilting mechanism is also disclosed which comprises a rack connected to a swivel mounting and a swivel locking tooth which works together with the rack. This locking mechanism has a mechanically low bearing capacity.

SUMMARY OF THE INVENTION

According to the invention an optional locking capability of the second mounting in its normal position can be obtained without any noticeable extra cost, since locking lugs and the guide for the locking slide can be moulded virtually without extra cost by pressure moulding the mountings (generally aluminium).

With the further development of the invention according to one embodiment, a particularly compact structure of the joint connecting the two mountings is also obtained.

With the further development of the invention according to another embodiment, it is simple to ensure that the second mounting cannot be moved in the direction of the joint axis relative to the first mounting, so that no lateral loads are applied on the leaf springs.

With a seat mechanism according to another embodiment, the flexibility of the springs can easily be adjusted by the user. In accordance with another embodiment, an alternative lock capability for the second mounting in the normal position is obtained without considerable extra cost, since retaining studs and the guide for the locking slide can be moulded in virtually without extra cost by pressure moulding the mountings (generally aluminium).

Similarly, in accordance with another embodiment, and also without extra expense, stops are provided which define the normal position of the second mounting.

The further development of the invention in accordance with another embodiment, guarantees a particularly small angle of pitch of the leaf springs relative to the plane of the second mounting and thus a particularly small overall height of the seat mechanism.

DRAWINGS

The invention is explained below in greater detail by means of a design example, with reference to the drawings.

PREFERRED EMBODIMENT

Figure 1:
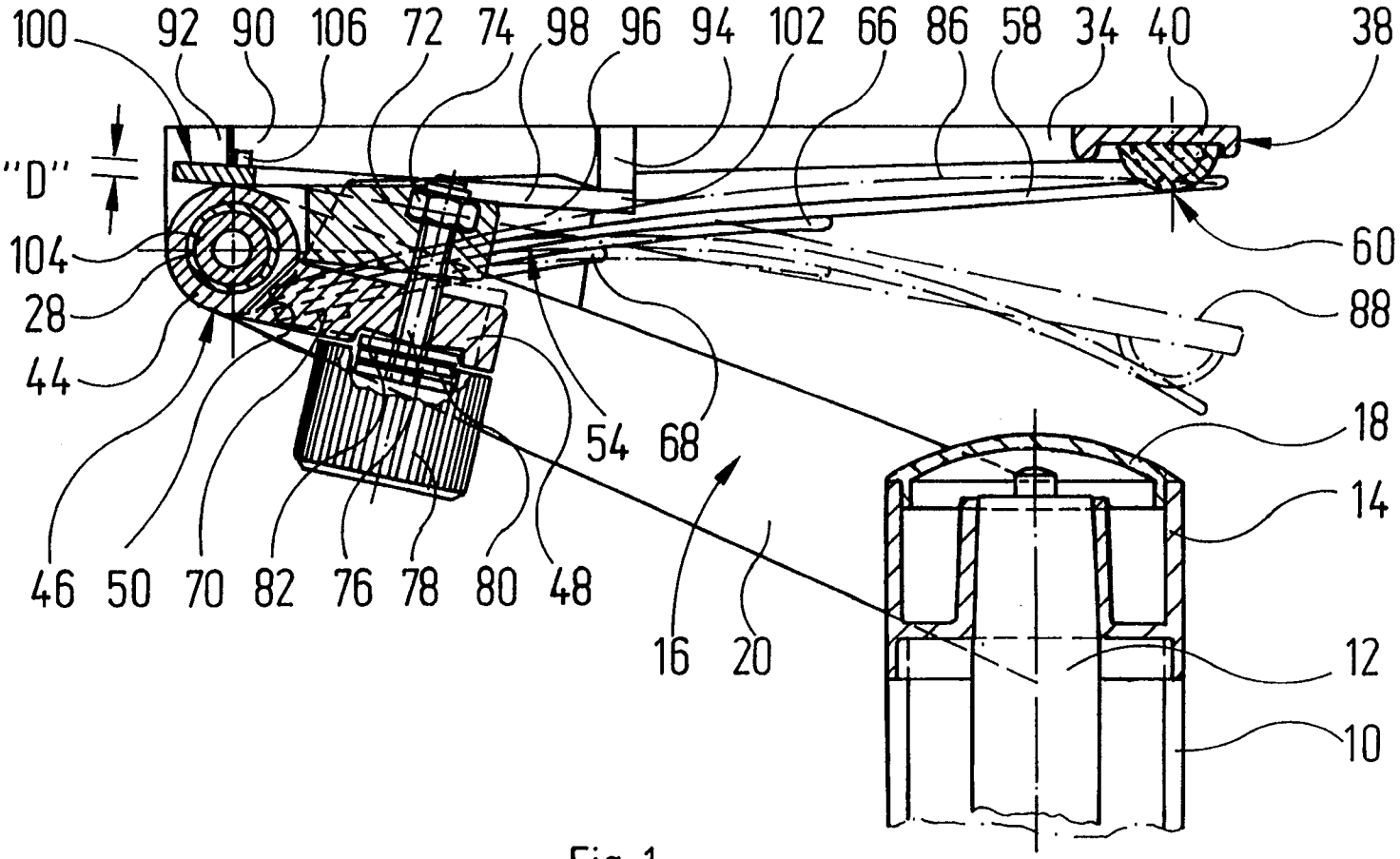
FIG. 1 shows a vertical longitudinal section through a swivel chair seat mechanism along the section lines I—I of FIGS. 2 and 3.

In FIG. 1, the number 10 represents the top of a swivel chair frame which is height-adjustable for example by means of a lockable gas spring 2.

A bearing lug 14 on a lower mounting designated by the number 16 is mounted on the top end of the frame. The bearing lug is closed at the top by means of a plastic cap 18. The lower mounting 16 is an aluminum pressure die casting part and in plan view has the form of a truncated isosceles triangle or trapezium. Two mounting arms 20, 22 run sideways outwards and upwards from the bearing lug. Retaining sleeves 24, 26 are moulded onto the free ends of the mounting arms 20, 22.

A hollow axle 28 is secured in the retaining sleeves 24, 26, on which joint sleeves 30, 32 are swivel-mounted.

The joint sleeves 30, 32 are moulded onto the free ends of two mounting arms 34, 36 which are part of an upper swivel mounting, numbered 38. Seen in plan view, the latter also has the form of truncated isosceles triangle or trapezium, but in plan view the mounting arms 34, 36 essentially run parallel outside the mounting arms 20, 22. The ends of the mounting arms 34, 36 set apart from the joint sleeves 30, 32 are linked together by a base section 40. Four holes 42 in the upper mounting 38 are used as fastening possibilities for the seat of the swivel chair which is not shown in the drawing.

Figure 2:
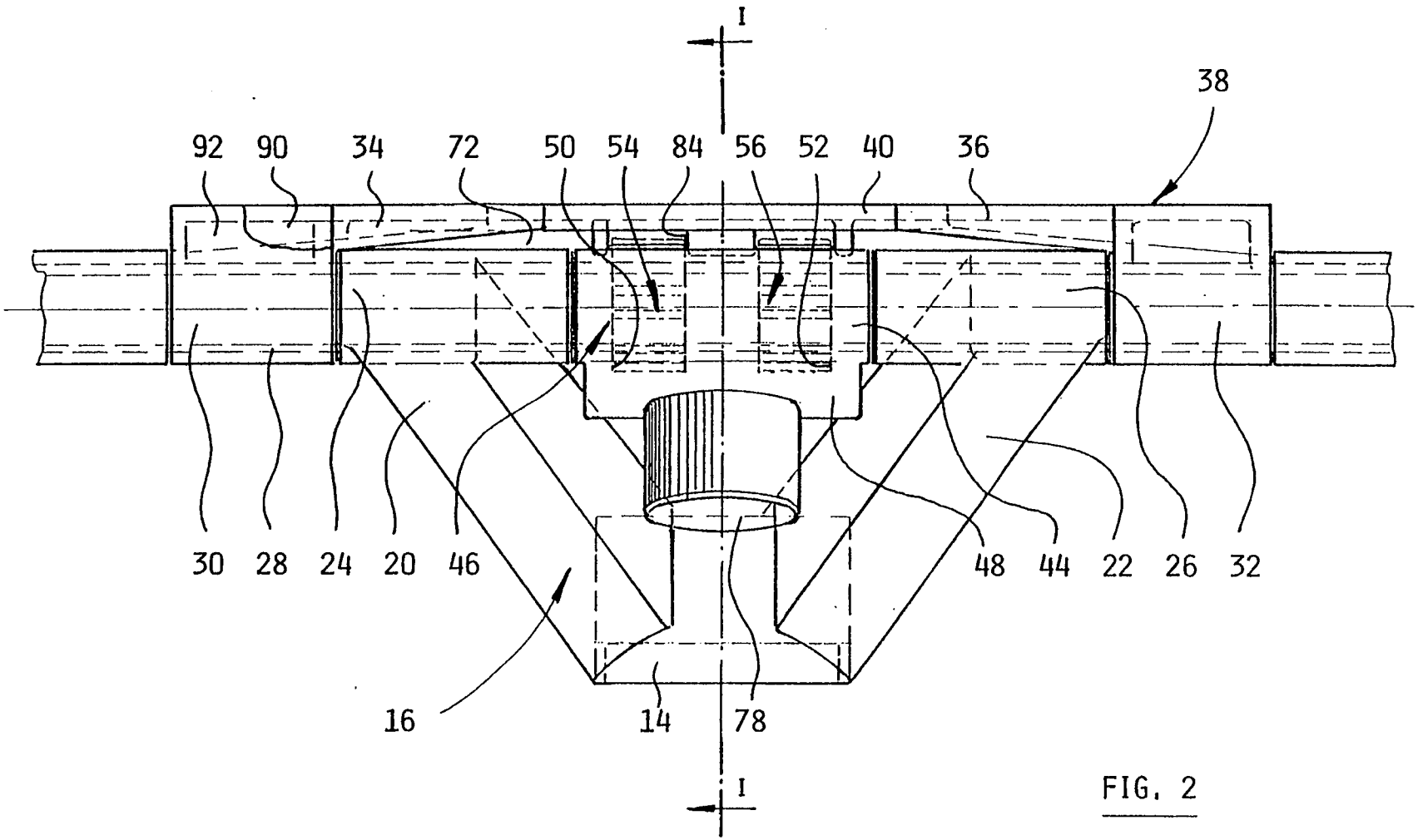
FIG. 2 shows a plan view of the front of the seat mechanism according to FIG. 1 (viewed in FIG. 1 from the left)
Figure 3:
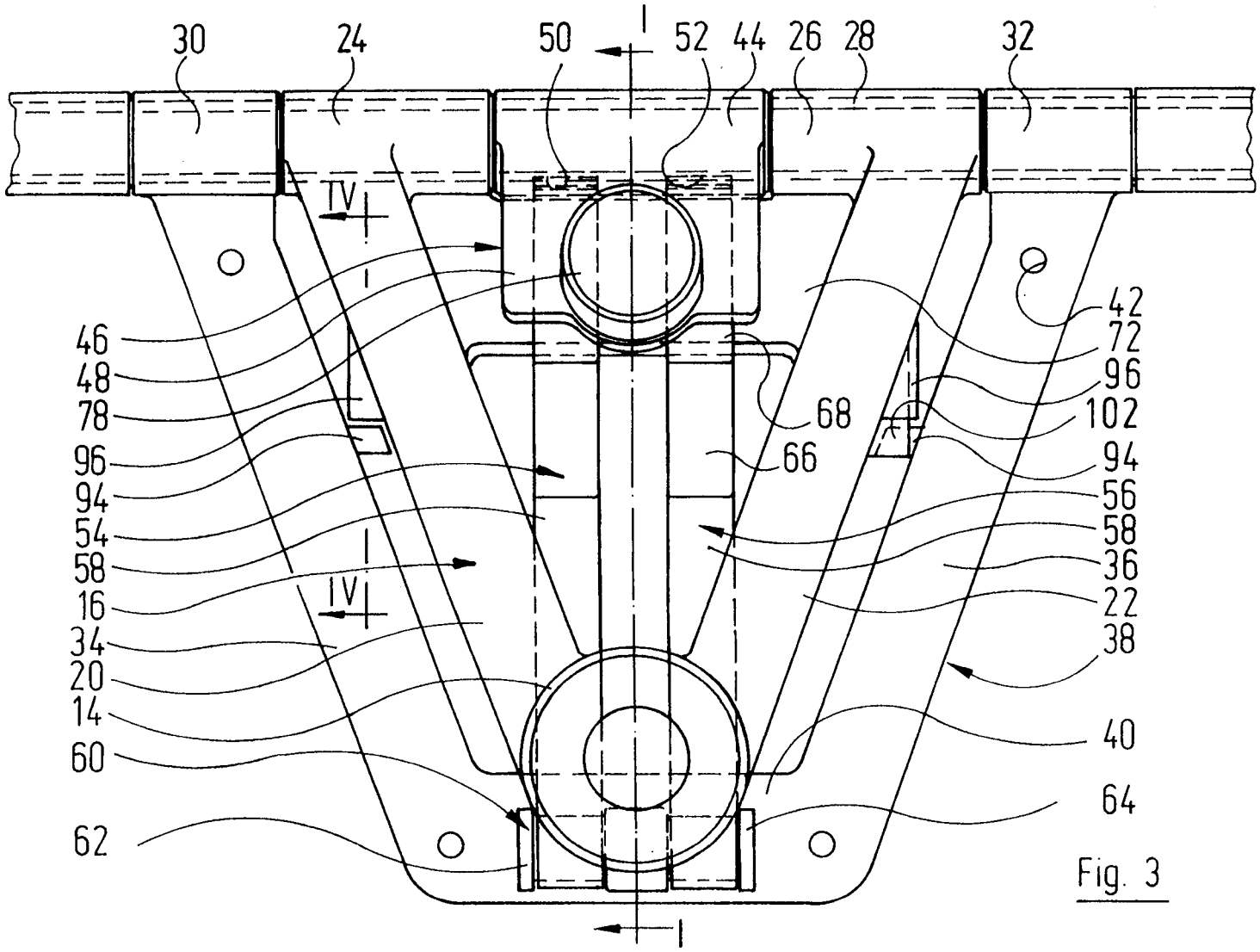
FIG. 3 shows a plan view of the underside of the seat mechanism according to FIG. 1.
Figure 4:
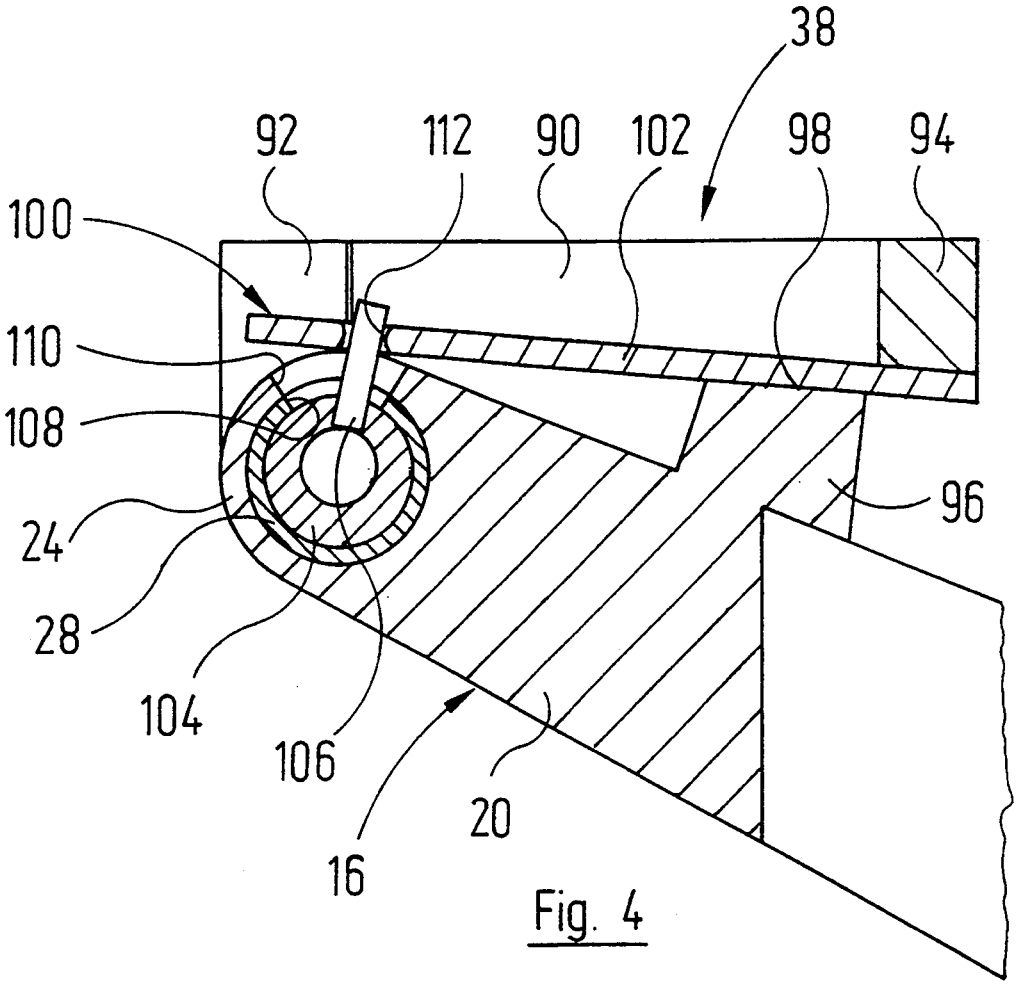
FIG. 4 is a sectional view taken along IV—IV of FIG. 3.
Figure 5:
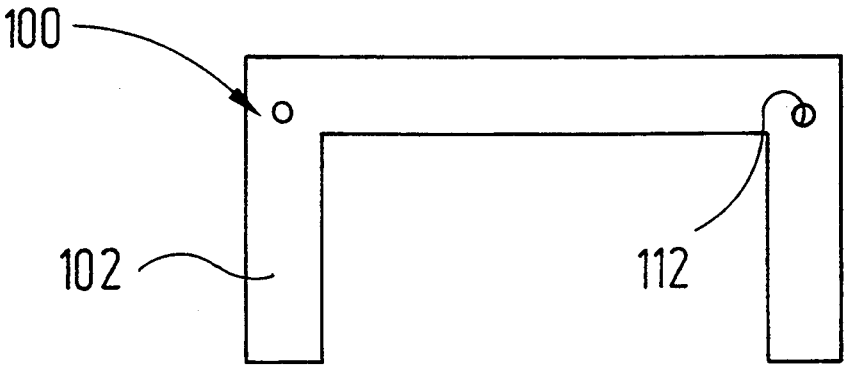
FIG. 5 is a plan view of a rectangular U-shaped locking slide.

As can be seen from FIGS. 2 and 3, the axially external faces of the retaining sleeves 24, 26 are in sliding contact with the axially internal faces of the joint sleeves 30, 32 so that the mounting 38 cannot slide relative to mounting 16 on the hollow axle 28.

An additional joint sleeve 44 is mounted on the hollow axle 28 with sliding clearance between the axially internal faces of the retaining sleeves 24, 26. This is moulded onto a spring seat part designated 46 which also comprises a clamping wing 48 running tangentially from the lower end of the joint sleeve 44.

Two recesses 50, 52 which receive the first ends of the leaf spring assemblies designated by 54 and 56, are provided in the spring seat part 46 symmetrical to the median plane of the seat mechanism.

The leaf spring assemblies 54, 56 each consist of a long upper leaf spring 58 which is guided under the base section 40 of the upper mounting 38 and engages on the base section 40 via a contact member 60 which is semi-circular in cross-section. The contact member 60 is an injection moulded part made of a plastic material which is resistant to wear for the material of the leaf springs 58 has low coefficients of friction, Collars 62 and 64 on the contact member are used to position the ends of the leaf springs 58 laterally.

The leaf spring assemblies 54, 56 also comprise a centre leaf spring 66 which extends approximately to the centre of the upper mounting 38 and a lower leaf spring 68, the length of which is approximately one third of the length of the leaf spring 58.

The leaf springs 58, 66, 68 all have the same width and thickness and are seated with their ends similarly in recess 50 and 52 where they are secured by a bolt 70 going through it.

A support section 72 connecting the ends of the mounting arms 20, 22 and in which a nut 74 is secured, is formed on to the lower mounting 16. The thread of a threaded spindle 76 runs in this nut, the end of the spindle being connected torsionally tight to a knob 78. The threaded spindle 76 goes through the clamping wing 48 with clearance and the top of the knob 78 engages in a knife-edge shaped surface section 82 in the bottom of the clamping wing 48 via a ball bearing 80.

The leaf spring assemblies 54, 56 are received with clearance in groove-shaped recesses 84 formed in the bottom of the support section 72.

The pitch of the screw drive mechanism formed by the threaded spindle 76 and the nut 74 is small (fine thread), with the result that the angle at which the recesses 50, 52 are pitched can easily be changed against the force of the leaf spring assemblies 54, 56 by turning the knob 78. With this change in angle, the initial tension of the leaf spring assemblies 54, 56 also changes. In FIG. 1, the unbroken line shows the shape of the leaf spring assembly with no load applied on the seat and medium initial stressing force. If the knob 78 is turned clockwise, the angle of pitch of the recesses 50, 52 relative to the horizontal can be increased, so that the shape of the leaf spring 58 is as shown by the dotted line numbered 86. The downward pressures of the upper mounting 38 then require greater force.

In FIG. 1, the dotted lines 88 represent one position of the upper mounting 38 obtained by loading the seat.

To give the normal position of the mounting shown in FIG. 1 by unbroken lines, the upper mounting has, on the ends of the mounting arms 34, 46 on the side of the joint, inwards projecting stop sections 90 which work together with the stationary stop sections 92 of the lower mounting 16 running upwards from the retaining sleeves 24, 26.

In order to be able to lock the seat mechanism when the upper mounting 38 is in the raised position, the inside surfaces of the mounting arms 34, 36 carry locking parts 94, which with clearance can be moved away via locking parts 96 carried on the outer surfaces of the mounting arms 20, 22. When the upper mounting 38 is in the normal position, the bottom surface of the locking parts 94 is a slight distance D above the upper surface of the adjacent locking parts.

A locking slide designated with 100 can be moved on the flat top of the locking parts 96 and on one connecting guide surface 98 of the lower mounting 16. The thickness of this slide is somewhat smaller than the distance D, with the result that the arms 102 of the rectangular U-shaped locking slide can be inserted between the faces of the locking parts 94, 96. When the locking slide 100 is in this position, the upper mounting 38 can no longer be swivelled downwards.

The locking slide 100 can be moved for example by means of a shaft 104 mounted inside the hollow axle 28 which carries radial control pins 106 which go through slots 108, 110 running in the peripheral direction in the hollow axle 28 and the retaining sleeves 24, 26 respectively and engage flexibly with tilt capability in tappet holes 112 in the locking slide 100.

We claim:

1. A mechanism for mounting the seat of a swivel chair on a chair frame (10) comprising (a) a first mounting (16) which is adapted to be connected to a chair frame (10), (b) a second mounting (38) that is connected to said first mounting (16) via a pivot joint (24, 26, 28, 30), said second mounting being adapted to be connected to a seat, (c) a leaf spring arrangement (54) having two ends that pretension said second mounting (38) in an upper position, one end of which is supported by a mounting adjacent said pivot joint (24, 26, 28, 30) and the other end of which engages a portion of said second mounting (38) that is spaced away from said pivot joint (24, 26, 28, 30), (d) first locking parts (96) on said first mounting (16), (e) second locking parts (94) on said second mounting (38) that are located adjacent said first locking parts (96) and at a spaced distance therefrom so as to form a gap therebetween, and (f) a locking slide (100) movably supported on said first mounting (16), said locking slide (100) being movable into said gap so that said second mounting (38) cannot move downwardly with respect to said first mounting (16) and being movable out of said gap so that said second mounting (38) can move downwardly with respect to said first mounting (16).

2. A mechanism according to claim 1 wherein said first locking parts (96) are located further away from pivot joint (24, 26, 28, 30) than said second locking parts (94) when measured radially from said pivot joint (24, 26, 28, 30).

3. A mechanism according to claim 1 wherein said pivot joint (24, 26, 28, 30) has at least two retaining sleeves (24, 26) concentric to the axis of said pivotable joint (24, 26, 28, 30), an axle (28) carried by the retaining sleeves (24,26) and at least two joint sleeves (30, 32) provided on said second mounting (38) and rotatably arranged on the axle (28).

4. A mechanism according to claim 3 wherein said axle (28) is a hollow axle in which a control shaft (104) is mounted which carries radial control pins (106) cooperating with said locking slide (100).

5. A mechanism according to claim 3 wherein said at least two retaining sleeves (24, 26) and said at least two joint sleeves (30, 32) are each in sliding contact via adjacent pairs of faces.

6. A mechanism according to claim 3 wherein said one end of said leaf spring arrangement (54) is swivel-mounted on said axle by a spring seat part (46) and by a supporting part (72), said spring seat part (46) and said supporting part (72) being movable with respect to each other by a threaded adjustment means (74, 76).

* * * * *